US007431597B2

(12) United States Patent
Yamashita

(10) Patent No.: US 7,431,597 B2
(45) Date of Patent: Oct. 7, 2008

(54) LEVER-TYPE CONNECTOR

(75) Inventor: Kazunori Yamashita, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/923,752

(22) Filed: Oct. 25, 2007

(65) Prior Publication Data

US 2008/0102666 A1 May 1, 2008

(30) Foreign Application Priority Data

Oct. 30, 2006 (JP) ..... 2006-293984

(51) Int. Cl.
*H01R 13/62* (2006.01)

(52) U.S. Cl. ..... 439/157

(58) Field of Classification Search ..... 439/152–160, 439/140–141, 597, 310, 372, 341–345, 357–358, 439/350–351

See application file for complete search history.

(56) References Cited

U.S. PATENT DOCUMENTS 6,832,922 B2 * 12/2004 Kozono et al. ..... 439/135
7,201,591 B2 * 4/2007 Fujii ..... 439/157
7,249,958 B2 * 7/2007 Ishikawa et al. ..... 439/141

FOREIGN PATENT DOCUMENTS

JP 10-214653 8/1998

* cited by examiner

*Primary Examiner*—Edwin A. León
(74) *Attorney, Agent, or Firm*—Gerald E. Hespos; Anthony J. Casella

(57) ABSTRACT

A first housing (10) is provided with a tubular hood (12) and a rotatable lever (30). A lock (32) on the lever (30) and a to-be-locked portion (21) provided on the hood (12) are locked to each other at an open end side of the hood (12) when the first and second housings (10; 50) have been fit normally together. Thus, rotation of the lever is prevented. A hold-down portion (52) on the second housing (50) covers the open end of the hood (12) when the first and second housings (10; 50) have been fit normally together and prevents the open end of the hood (12) from elastically deforming in a return direction of the lever (30) while unlocking the to-be-locked portion (21) and the lock (32) from each other.

9 Claims, 5 Drawing Sheets

LEVER-TYPE CONNECTOR

BACKGROUND OF THE INVENTION

1. Field of the Invention

The invention relates to a lever-type connector.

2. Description of the Related Art

Japanese Patent Application Laid-Open No. 10-214653 disclose a lever-type connector having first and second housings made of synthetic resin and configured to be fit together. The first housing has a hood, and a lever is supported rotatably on the outer surface of the hood. A cam groove is formed on the lever and a cam pin is provided on the outer surface of the second housing at a position corresponding to the cam groove. The lever is provided with a lock and a flexible locking arm is provided at the open end of the hood.

The second housing is fit in the hood so that the cam pin engages the entrance of the cam groove. The lever then is rotated. As a result, the housings are fit together due to the cam operation performed by the engagement between the cam pin and the cam groove. The lock and the locking arm are locked elastically together at the open end of the hood when the housings have been fit normally together. Thus, further rotation of the lever is prevented, and both housings are locked in a fit-in state. The locking arm and the lock can be unlocked from each other so that the lever can be rotated in the return direction to separate the housings.

An attempt can be made to rotate the lever in the return direction without completely unlocking the locking arm from the lock. In this situation, the open end of the hood may follow the rotation of the lever and may elastically deform in the return direction of the lever. Consequently, the operation of separating the connectors can be difficult for the operator and there is a fear that the hood will plastically deformed.

The invention has been completed in view of the above-described situation. Therefore it is an object of the invention to separate first and second connectors from each other efficiently and to prevent a hood from being deformed plastically.

SUMMARY OF THE INVENTION

The invention provides a lever-type connector including first and second housings. The first housing is provided with a tubular hood and a rotatable lever. The second housing can be fit slightly into the hood of the first housing. The lever then is rotated towards an open end of the hood to generate a cam action between the lever and the second housing. The cam action urges the housings into a connected state. A lock on the lever locks to a to-be-locked portion on the hood when the housings are connected properly to prevent further operation of the lever. However, the lock can be unlocked from the to-be-locked portion so that the lever can be rotated in a return direction for separating the housings. The connector also includes a hold-down portion at a position covering the open end of the hood. The hold-down portion is configured to prevent the open end of the hood from elastically deforming in the return direction of the lever after the two housings have been fit together properly.

The hold-down portion preferably is provided on the second housing covers the open end of the hood when the first and second housings have been fit together normally.

The hold-down portion preferably is disposed at the open end of the hood to cover a to-be-held down portion disposed at both sides of the to-be-locked portion.

The housings are separated from each other by unlocking the lock and the to-be-locked portion from each other in the state where the housings are fit normally together and then rotating the lever in the return direction. The open end of the hood could try to follow the return operation of the lever if the to-be-locked portion and the lock are incompletely engaged. However, the hold-down portion is located to cover the open end of the hood and prevents the open end of the hood from plastically deforming. Therefore it is possible to unlock the to-be-locked portion and the lock from each other rapidly and smoothly and avoid a plastic deformation of the hood.

Further, the hold-down portion of the second housing covers the open end side of the hood when both housings and are fit normally together. Thus, flexing at the open end of the hood is permitted until both housings are fit normally together. A fit-in posture of the second housing can be corrected by the elastic deformation of the open end of the hood while fitting the second housing in the hood. Further it is possible to simplify the construction of the first housing.

Further, the hold-down portion covers the to-be-held down portion at both sides of the to-be-locked portion at the open end of the hood. Therefore it is possible to securely prevent the open end of the hood from elastically deforming in the return direction of the lever when the to-be-locked portion and the locking portion are unlocked from each other.

DETAILED DESCRIPTION OF THE PREFERRED EMBODIMENTS

A lever-type connector in accordance with the invention includes first and second connectors F and M that are configured to be fit together. The first connector M has a first housing 10 and a lever 30. The second connector F has a second housing 50. In the following description made, ends of the housings 10 and 50 that connect to one another are referred to as the front ends.

Figure 2:
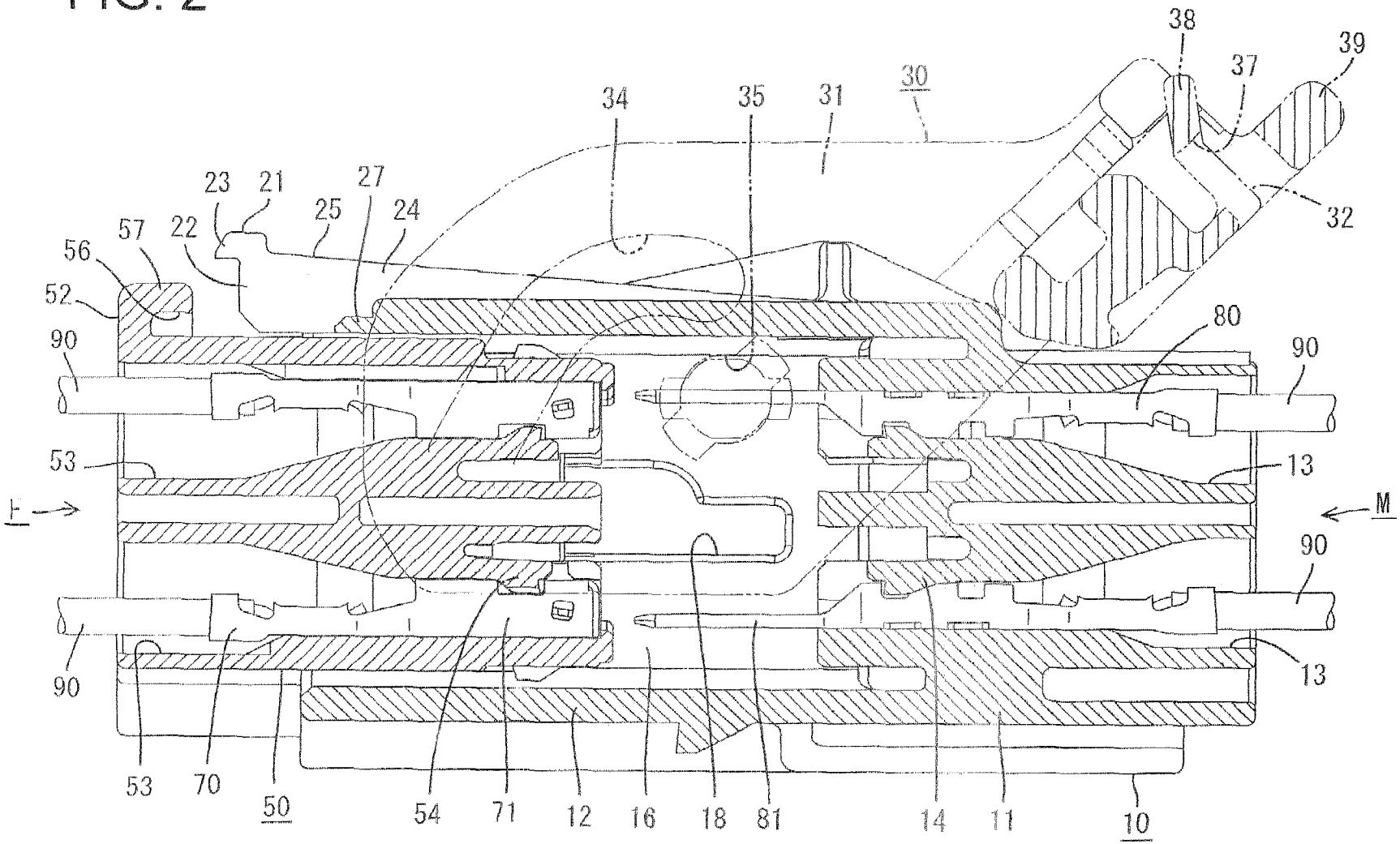
FIG. 2 is a side sectional view showing a state before an operation of fitting both housings starts with a lever disposed at an initial position.
Figure 3:
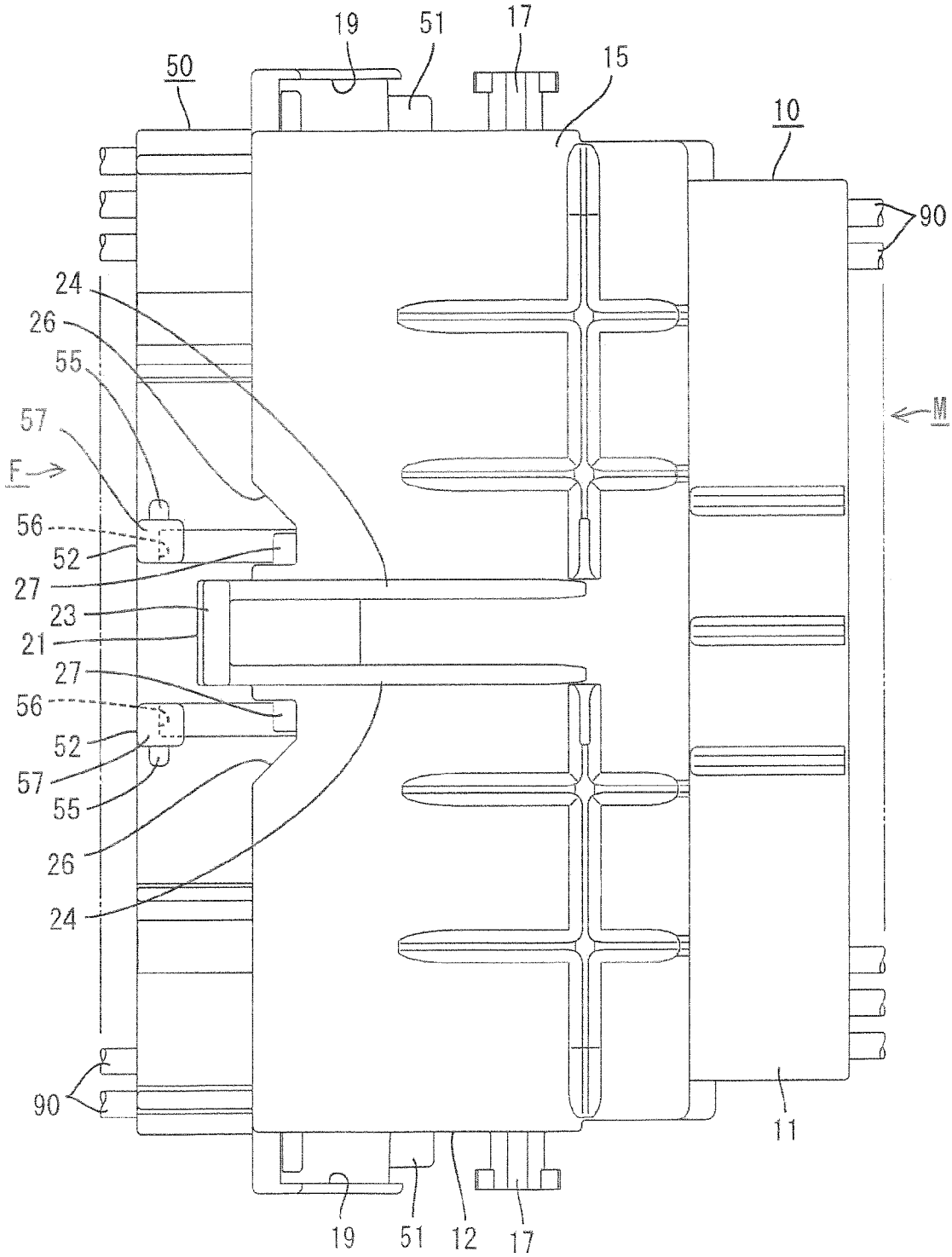
FIG. 3 is a plan view showing a state in which both housings have been fit shallowly together.

The first housing 10 is made of synthetic resin and is long and narrow in the width direction. As shown in FIGS. 2 and 3, the first housing 10 has a rectangular block-shaped terminal fitting accommodation part 11 and a hood 12 disposed forward of the terminal fitting accommodation part 11. The hood 12 projects in the shape of a rectangular pillar or tube. Cavities 13 are formed at upper and lower steps inside the terminal fitting accommodation part 11 and lances 14 are formed back to back on inner walls of the cavities 13. Male terminal fittings 80 connected with ends of electric wires 90 are inserted respectively into the cavities 13 in a vertically symmetrical posture from a rear end of each cavity 13. The lance 14 securely locks the male terminal fitting 80 that has been inserted properly into the cavity 13. A tab 81 is formed at the front end of each male terminal fitting 80 and projects forward inside the hood 12.

The hood 12 has two opposed longer-sides 15 that confront each other vertically in the height direction and two opposed shorter-sides 16 that confront each other in the left-to-right direction. The longer-sides 15 and the shorter-sides 16 constitute the four sides of the hood 12. The hood part 12 is has thin walls, and thus can be deformed elastically by an external force.

Two approximately columnar shafts 17 project from rear parts of outer surfaces of the shorter-sides 16 of the first housing 10 for supporting the lever 30. Left and right grooves 18 are formed on the shorter-sides 16 and extend longitudinally rearward from the front end thereof along the direction in which the housings 10 and 50 are fit together and separated from each other. A cam pin 51 of the second housing 50 advances into each groove 18 when the second housing 50 is fit in the hood 12. Concave accommodating portions 19 are formed near the front ends of the outer surfaces of the shorter-sides 16 for accommodating peripheral edges of an arm 31 on the lever 30.

A to-be-locked portion 21 is provided at approximately a widthwise center of an upper wall of the longer-side 15 of the hood 12 at the open front end thereof. The to-be-locked portion 21 is disposed slightly forward from the open end of the hood 12. The to-be-locked portion 21 is composed of an upwardly erect supporting leg 22 and a locking claw 23 that projects forward from an upper end of the supporting leg 22 to define an L-shape in section. Left and right triangular ribs 24 are formed from the left and right sides of a rear surface of the supporting leg 22 to an upper surface of an upper wall of the hood 12 for reinforcing the supporting leg 22. Each rib 24 has an oblique side 25 that gently descends towards the rear. The to-be-locked portion 21 is locked elastically to a lock 32 provided on the lever 30.

As shown in FIG. 3, a fit-in concavity 26 is defined at left and right sides of the ribs 24 of the to-be-locked portion 21, and can receive a hold-down portion 52 on the second housing 50 when both housings 10 and 50 are fit together. The fit-in concavity 26 defines an approximately trapezoidal recess at a front end of the hood 12. Left and right to-be-held down portions 27 are provided at the rear of the fit-in concavity 26 and can be held down by the hold-down portion 52. The to-be-held down portions 27 are square plates in a plan view. An upper surface of each to-be-held down portion 27 is disposed below the upper surface of the upper wall of the hood 12 to define a step that contacts the hold-down portion 52 from below. Additionally, the to-be-held down portion 27 is thinner than the parts of the upper wall of the hood 12 disposed on the periphery of the to-be-held down portion 27.

Figure 5:
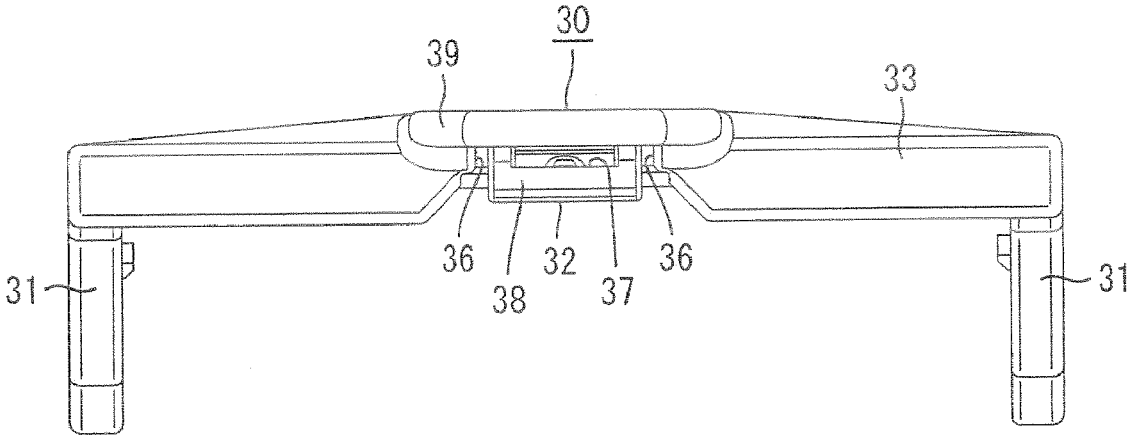
FIG. 5 is a front view of the lever.

The lever 30 is made of synthetic resin. As shown in FIG. 5, the lever 30 is composed of a long narrow operating portion 33 that extends widthwise and plate-shaped arms 31 that project from left and right ends of the operating portion 33. Thus, the lever 30 is substantially U-shaped or gate-shaped. The operating portion 33 is disposed over and across the first housing 10 so that the arms 31 are disposed along the left and right side surfaces of the first housing 10. Thus, the lever 30 is mounted on the first housing 10 with the lever 30 straddling over the first housing 10.

As shown in FIG. 2, a cam groove 34 is formed on each arm 31 and opens on the periphery of the respective arm 31. A bearing 35 penetrates through each arm 31 in a thickness direction thereof and in the neighborhood of the cam groove 34. The shaft 17 can be fit in the bearing 35 of each arm 31 so that the lever 30 is rotatable between an initial position (see FIG. 2) and a fit-in position (see FIG. 1). An upward projected amount of the arm 31 relative to the first housing 10 is large when the lever 30 is in the initial position (FIG. 2) and the operating portion 33 is disposed in the terminal fitting accommodation part 11. The upward projected amount of the arm 31 relative to the first housing 10 is small when the lever 30 is the fit-in position (FIG. 1) and the operating portion 33 is disposed at the open end of hood 12.

Entrances of the cam grooves 34 are open forward and communicate with the cut grooves 18 when the lever 30 is at the initial position. Thus, the cam pins 51 on the second housing 50 can advance into the cam grooves 34. The peripheries of both arms 31 are stepped down in a predetermined range and are accommodated in the accommodating concave portions 19. The disposition of the peripheries of both arms 31 in the accommodating concave portions 19 prevents the arms 31 from opening.

Figure 1:
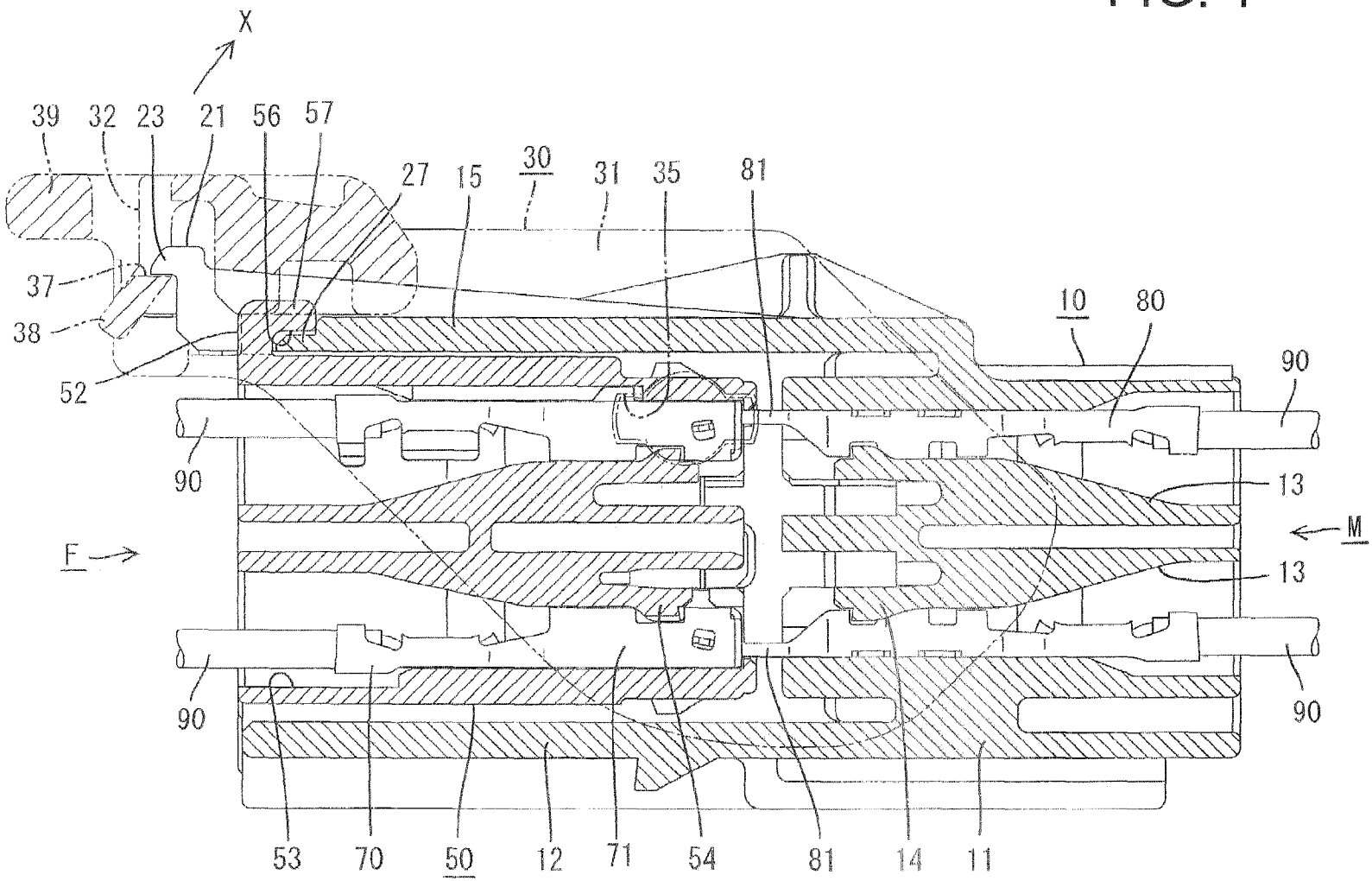
FIG. 1 is a side sectional view showing a state in which both housings of the invention have been fit together.

The lock 32 is formed at approximately the widthwise center of the operating portion 33 and hangs down from an innermost portion of the operating portion 33 towards the to-be-locked portion 21 so that the lock 32 can be locked to the to-be-locked portion 21. Slits 36 are formed at both sides of the lock 32 so that the lock 32 can be deformed elastically. An open oblong locking hole 37 is formed at an inner part of lock 32. The locking claw 23 fits in the locking hole 37 of the lock 32 and is locked to the edge of the locking hole 37 when the lever 30 is rotated to the open end of the hood 12 and into the fit-in position. Thus, the lever 30 is locked in a rotation-prevented state at the fit-in position, as shown in FIG. 1. Parts of the lock 32 extending from the root at the upper end of the lock 32 to the lower edge of the locking hole 37 are aligned approximately vertical in FIG. 1 and extend normal to the connecting direction of the housings. Parts of the lock 32 extending from the locking hole 37 to the free end of the lock 32 taper obliquely down and forward. The tapered portion of the lock 32 defines a holding portion 38 that is held with fingers to perform an unlocking operation so that the lever 30 can be rotated in are turn direction. An arch-shaped protection wall 39 is provided at approximately the widthwise center of the operating portion 33 and projects forward and surrounds the periphery of the lock 32. The protection wall 39 protects the lock 32 from being interfered with by an external foreign matter (including a finger).

The second housing 50 is made of synthetic resin and has an oblong block shape. Cavities 53 are formed inside the second housing 50 at positions corresponding to the cavities 13 of the first housing 10. Female terminal fittings 70 connected with the ends of the electric wires 90 can be inserted into the cavities 53 from the rear end of the second housing 50. A flexible lance 54 is formed on an inner wall of each cavity 53. The cavity 53 and the lance 54 have almost the same configuration as that of the cavity 13 and the lance 14 of the first connector housing 10 respectively. The female terminal fitting 70 has a rectangular tubular portion 71 for receiving the tab 81 of the male terminal fitting 80. Cam pins 51 project from the left and right outer side surfaces of the second housing 50.

Left and right hold-down portions 52 project from positions near the widthwise center of the upper surface of the second housing 50 and near the rear end of the second housing 50. Each hold-down portion 52 is erect in the shape of a substantially rectangular pillar. Left and right ribs 55 extend laterally from outer sides of the hold-down portions 52 to the upper surface of the second housing 50. Each rib 55 is a substantially triangular and plate-shaped and functions to reinforce the respective hold-down portion 52. Open fit-in spaces 56 are formed on inner confronting side surfaces of the hold-down portion 52 and a front surface thereof. A section of each hold down portion 52 above the respective fit-in space 56 defines a hold-down body 57. The to-be-held down portion 27 is fit longitudinally in the fit-in space 56 of the hold-down portion 52 as the housings 10 and 50 are fit together. Thus, the hold-down body 57 of each hold-down portion 52 covers the upper surface of the to-be-held down portion 27. The lower surface of the hold-down body 57 and the upper surface of the to-be-held down portion 27 confront each other in the return direction of the lever 30, which is the opening direction of the to-be-held down portion 27 and the hood 12. Thus the hold-down body 57 prevents the hood 12 from opening (elastic deformation).

The lever 30 of the first housing 10 is held at the initial position so that the housings 10 and 50 can be fit together. In this state, the second housing 50 is fit shallowly in the hood 12, as shown in FIG. 2. As a result, the cam pin 51 advances into the entrance of the cam groove 34. The lever 30 then is rotated towards the open end by an operator who uses his or her fingers to hold the operating portion 33, for example, the protection wall 39. As a result, both housings 10 and 50 are drawn towards the normal fit-in state due to a cam action generated by the engagement between the cam groove 34 and the cam pin 51. The hold-down portion 52 advances into the fit-in concavity 26 and the hold-down body 57 covers the to-be-held down portion 27 immediately before the housings 10 and 50 reach the normal fit-in state. The lock 32 of the lever 30 rides over the locking claw 23 of the to-be-locked portion 21 and is deformed elastically at the last stage in the operation of fitting the housings 10 and 50 together.

Figure 4:
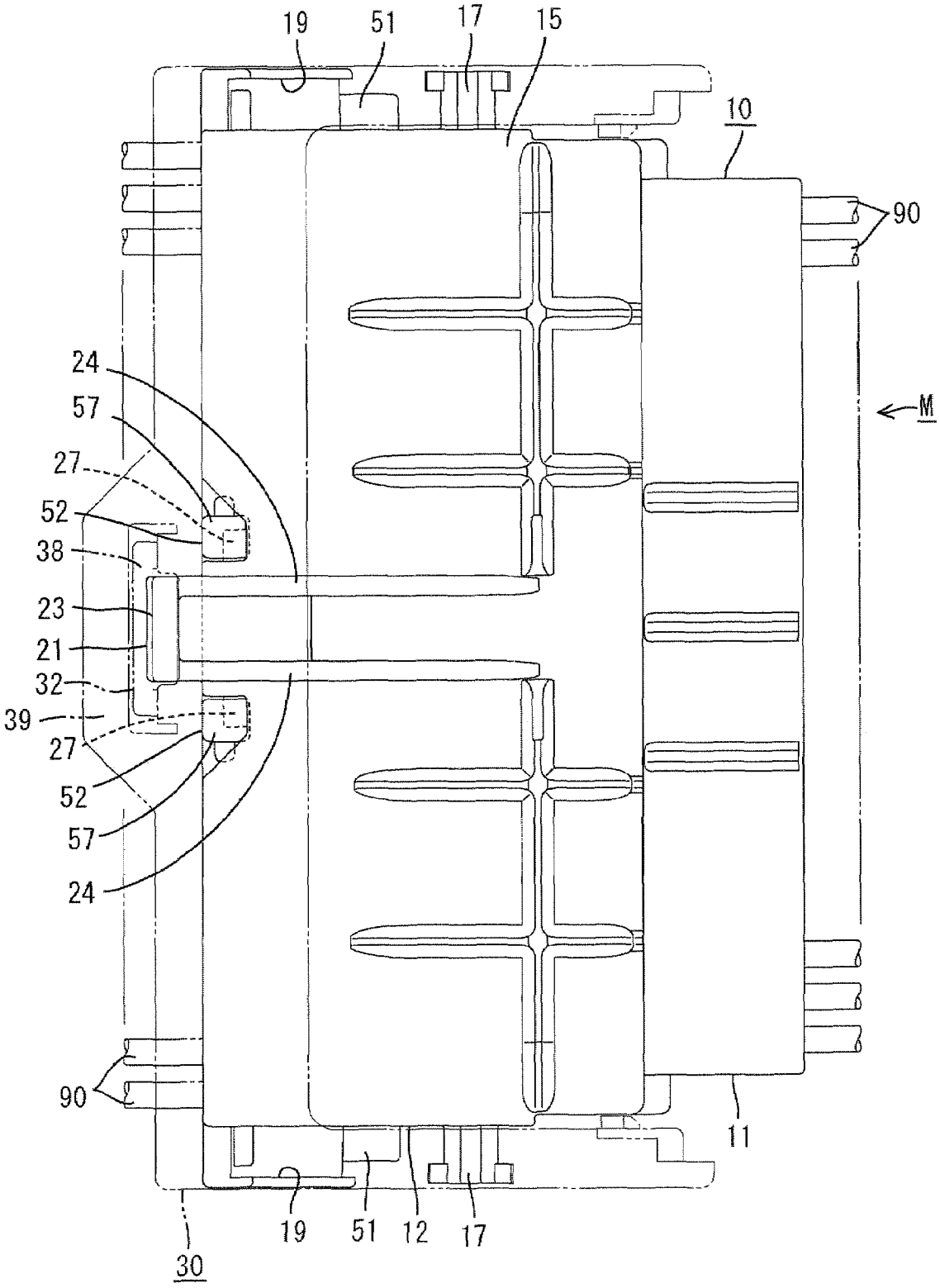
FIG. 4 is a plan view showing a state in which both housings have been fit normally together.

As shown in FIGS. 1 and 4, the locking claw 23 of the to-be-locked portion 21 is fit in the locking hole 37 of the lock 32 when both housings 10 and 50 have been fit together properly, and the lock 32 elastically returns to its original state. Rotation of the lever 30 is prevented when the lock 32 is locked elastically to the to-be-locked portion 21, and hence both housings 10 and 50 are locked by the lever 30 in a separation-prevented state. In this state, the front end of the lock 32 is rearward of the rear end of the second housing 50 with the upper part of the hold-down portion 52 covered by the operating portion 33 of the lever 30. The female terminal fittings 70 in the second housing 50 and the male terminal fittings 80 in the first housing 10 are connected electrically with each other in a predetermined normal depth when both housings 10 and 50 have been fit normally together.

The connectors F and M may have to be separated from each other for maintenance or the like. For this purpose, the holding portion 38 is held by an operator's fingers and is lifted in a return or unlocking direction of the lever 30. As a result, the lock 32 moves away from the locking claw 23 to unlock the locking portion 32 and the locking claw 23 from each other. Thus, the lever 30 can be rotated in the return direction and to the initial position. The return rotation of the lever 30 separates the connectors F and M from each other due to the cam action of the lever 30.

In the above-described case, a pulling force towards the return direction of the lever 30 (direction of the arrow X of FIG. 1) is applied to the upper wall of the hood 12 if the operation of separating the lock 32 from the to-be-locked portion 21 is not performed smoothly. Thus, there is a fear that the upper wall of the first housing 10 opens (elastic deformation) at the open end thereof. However, the hold-down portion 52 (hold-down body 57) of the second housing 50 covers the to-be-held down portion 27 provided at the edge of the open end of the upper wall of the hood 12. Therefore when the to-be-held down portion 27 contacts the hold-down portion 52, it is possible to smoothly separate the to-be-locked portion 21 and the locking portion 32 from each other without the upper wall of the hood 12 opening (elastic deformation).

As described above, the open end of the hood 12 will try to follow the return operation of the lever 30 if the to-be-locked portion 21 and the lock 32 are partly engaged. However, the hold-down portion 52 covers the open end of the hood 12 and prevents the open end of the hood 12 from elastically deforming. Therefore, the to-be-locked portion 21 and the lock 32 can be unlocked from each other rapidly and smoothly without a plastic deformation of the hood 12.

When both housings 10 and 50 are fit normally and properly together, the hold-down portion 52 of the second housing 50 covers the open end of the hood 12. However, the open end of the hood 12 can flex until both housings 10 and 50 are fit normally together. A fit-in posture of the second housing 50 can be corrected by the elastic deformation of the open end of the hood 12 as the second housing 50 is being fit into the hood 12. It is possible to enhance the degree of freedom of design and simplify the construction of the first housing 10 as compared to the case where the hold-down portion 52 is on the first housing 10.

The hold-down portion 52 covers the to-be-held down portion 27 provided at both sides of the to-be-locked portion 21 at the open end of the hood 12. Therefore it is possible to prevent the open end of the hood 12 from elastically deforming in the return direction of the lever 30 when the to-be-locked portion 21 and the locking portion 32 are unlocked from each other.

The to-be-held down portion 27 at the open end of the hood 12 is below the periphery of the hood 12 by one step. The hold-down body 57 of the hold-down portion 52 fits in this lowered to-be-held down portion 27 at the open end of the hood 12. Thus the height of the hold-down portion 52 is low and it is possible to prevent the hold-down portion 52 and other parts from interfering with one another.

The invention is not limited to the embodiment described above with reference to the drawings. For example, the following embodiments are included in the technical scope of the present invention.

The hold-down portion may be on the first housing. For example, the hold-down portion may project to the open end of the hood.

The to-be-held down portion may be provided at one position of the open end of the hood or at not less than three positions thereof.

The to-be-held down portion may be flush with the upper surface of the hood disposed on the periphery thereof.

The to-be-held down portion should be disposed at the open end of the hood. The to-be-held down portion may be disposed not only on the upper wall of the hood, but also on the left and right side walls (shorter-sides) of the hood or on the lower wall of the hood. Because the longer-sides of the hood are more elastically deformable than the shorter-side thereof, it is preferable to set the to-be-held down portion on the longer-side of the hood. The to-be-held down portion may be provided on both longer-side and shorter-side portions of the hood.

What is claimed is:

1. A lever-type connector comprising:

a first housing having a tubular hood with an open front end and a to-be-locked portion formed in proximity to the open front end;

a second housing insertable into the open front end of the hood for connection with the first housing;

a lever mounted rotatably on the first housing and configured for generating a cam action with the second housing for connecting and disconnecting the housings, the lever having a lock for engaging the to-be-locked portion on the hood when the housings are connected properly for preventing further rotation of the lever and holding the housings together;

at least one hold-down portion provided on the second housing at a position for covering part of the open front end of the hood when the housings are connected properly for preventing said open front end of said hood from elastically deforming when the lever is rotated in a direction for separating the properly connecting housings.

2. The connector of claim 1, wherein the hold-down portion is formed unitarily with the second housing.

3. The connector of claim 1 wherein the lever has at least one cam groove and the second housing has at least one cam pin for engaging in the cam groove of the lever.

4. The connector of claim 1, wherein the lever has a holding portion disposed for deflecting the lock out of engagement with the to-be-locked portion for permit the lever to be rotated in a direction for separating the housings.

5. The connector of claim 1, wherein the first housing has at least one to-be-held down portion disposed at the front end of the hood, the hold-down portion being disposed for covering said to-be-held down portion.

6. The connector of claim 5, wherein the at least one to-be-held down portion is thinner than adjacent areas of the hood.

7. The connector of claim 5, wherein the hold-down portion is spaced from the to-be-held down portion when the housings are not connected properly to permit elastic deformation of the open front end of the hood during the connection of the housings.

8. The connector of claim 5, wherein at least part of the hold-down portion is disposed outwardly from and substantially adjacent to the to-be-held down portion in a direction substantially normal to connecting directions of the housings.

9. The connector of claim 8, wherein the at least one to-be-held down portion comprises to-be-held down portions at both sides of said to-be-locked portion.

* * * * *